US005636674A

United States Patent [19]

Benthin

[11] Patent Number: 5,636,674

[45] Date of Patent: Jun. 10, 1997

[54] VALANCE CORNER

[76] Inventor: Siegfried J. Benthin, Behringstr. 7, D-27574 Bremerhaven, Germany

[21] Appl. No.: 415,594

[22] Filed: Apr. 3, 1995

Related U.S. Application Data

[63] Continuation-in-part of Ser. No. 293,051, Aug. 19, 1994, abandoned.

[51] Int. Cl.[6] ..... E04F 10/00

[52] U.S. Cl. ..... 160/38; 160/39

[58] Field of Search ..... 160/38, 39, 19, 160/902; 403/12, 231, 403, 382; 16/87.4 R, 94 R, 96 R, 96 D, 95 R, 95 D; 5/493; 52/287.1, 282.3; 248/262

[56] References Cited

U.S. PATENT DOCUMENTS

| | | | |
|---|---|---|---|
| D. 318,592 | 7/1991 | Byrne | D6/579 |
| 2,501,133 | 3/1950 | Levy | 160/21 |
| 2,526,806 | 10/1950 | Charbonneau | 160/38 |
| 3,378,057 | 4/1968 | Synck | 160/39 |
| 3,435,876 | 4/1969 | Toti | 160/38 |
| 4,011,706 | 3/1977 | Dupree | 403/231 |
| 4,921,031 | 5/1990 | Wagner | 160/38 |
| 4,955,419 | 9/1990 | Morris | 160/38 |
| 5,031,438 | 7/1991 | Attal | 160/38 |
| 5,038,997 | 8/1991 | Peterson | 403/295 |
| 5,154,531 | 10/1992 | Peterson | 403/205 |
| 5,188,162 | 2/1993 | Simon | 160/166.1 |
| 5,259,687 | 11/1993 | John | 403/295 |

*Primary Examiner*—Blair Johnson

[57] ABSTRACT

A valance corner wherein a first panel (10) is pivotally joined to a second panel (12) by a hinge (38). Panel (10) includes fingers (40 and 42) that engage a valance return (52) and panel (12) includes fingers (44 and 46) that engage a valance headrail (58). A detent (60) includes plates (62) with barbs (67) and planar members (64) with grooves (68). The grooves (68) receive the barbs (67) to maintain panels (10 and 12) in predetermined angular relationship.

13 Claims, 7 Drawing Sheets

VALANCE CORNER

CROSS-REFERENCE TO RELATED APPLICATION

This application is a continuation-in-part of U.S. patent application Ser. No. 08/293,051 entitled "Valance Corner" which was filed Aug. 19, 1994 abandoned.

BACKGROUND OF THE INVENTION

1. Field of the Invention

The subject invention is directed to devices for concealing rods and tracs that support window and door coverings. More particularly, the subject invention is directed to valances for curtain rods and blind tracs.

2. Description of the Prior Art

In the prior art, many types of devices have been developed for concealing curtain rods, venetian blind tracks and similar mechanisms for covering window and door openings. Earlier examples include cornices such as described in U.S. Pat. Nos. 2,501,133 and 2,526,806. More recently, various types of valance structures have also been developed. Some of these valances, were designed to meet particular applications, such as described in U.S. Pat. No. 3,435,876, or to satisfy special needs such as described in U.S. Pat. No. 4,921,031.

Prior designs such as described above have presented a problem in that they tend to be bulky, making them relatively difficult and expensive to ship. Some prior art designs have attempted to address this problem. For example, U.S. Pat. No. 4,955,419 describes a valance having plastic hinges that connect the return panels to the front panels such that the front panels and return panels can be folded together for compact packaging. The hinge is provided with a tab that will lock the return panel in perpendicular relationship to the front panel. However, this design had to be molded as a single piece at the time of manufacture. Such foldable valances could not be conveniently sized and assembled at the place of installation. Since they could not be readily converted to fit a range of window sizes, they often entailed relatively long delivery times or required suppliers to carry large inventories.

More recently, other cornices and valances have been developed that can be more easily modified and assembled. Examples are shown in U.S. Pat. Nos. 5,042,548 and 5,259,687 wherein two corner pieces are used to join the end plates to the front panel of a cornice. Such devices could be more easily modified than many prior designs, but the corner pieces tended to be bulky and difficult to package. Also, the rigidity and angular shape of the corner pieces made them somewhat more susceptible to breakage during shipment. Moreover, these devices joined the front panel and end plates in a fixed, right-angular relationship so that valances could not be configured in curved or beveled arrangements.

Accordingly, there was a need in the prior art for a valance with flexible corners that could be easily assembled at the jobsite, that could be readily modified to fit various sizes and shapes of windows and doors, and that could be assembled in a variety of configurations.

SUMMARY OF THE INVENTION

In accordance with the subject invention, a connector joins a valance return and a valance headrail. The connector includes first and second panels that each have oppositely disposed edges. A hinge is connected to one edge of the first panel and also to one edge of the second panel to pivotally connect the first and second panels. A projection that extends from the first panel is shaped to engage the valance return and a second projection that extends from the second panel is shaped to engage the valance headrail. A detent maintains the first panel at a predetermined angular position with respect to said second panel. The detent includes one extension member that is connected to the first panel and a second extension member that is connected to the second panel. The one extension member has a lateral protrusion and the second extension member has a recessed area that receives the lateral protrusion at times when the first and second panels are at a predetermined angular position with respect to each other.

Preferably, the lateral protrusion has a surface that is generally inclined with respect to the second extension member with the apex of the inclined surface in the shape of a barb.

More preferably, the first extension member comprises a plate that has a lateral extension and the second extension member comprises two plates that are spaced laterally apart in parallel relationship such that the plate comprising the first extension is received between the parallel plates as the first and second panels are pivoted together about the hinge.

Most preferably, a stop is located between the two parallel plates of the second extension and the two plates include laterally extending lands that are oppositely disposed from each other. The laterally extending lands cooperate with portions of the plates and the stop to define a recess for receiving the lateral extension of the first extension member.

Other details, objects and advantages of the present invention will become apparent as the following description of the presently preferred embodiment proceeds.

BRIEF DESCRIPTION OF THE DRAWINGS

The accompanying drawings illustrate a preferred embodiment of the invention wherein.

PREFERRED EMBODIMENT OF THE SUBJECT INVENTION

Figure 1:
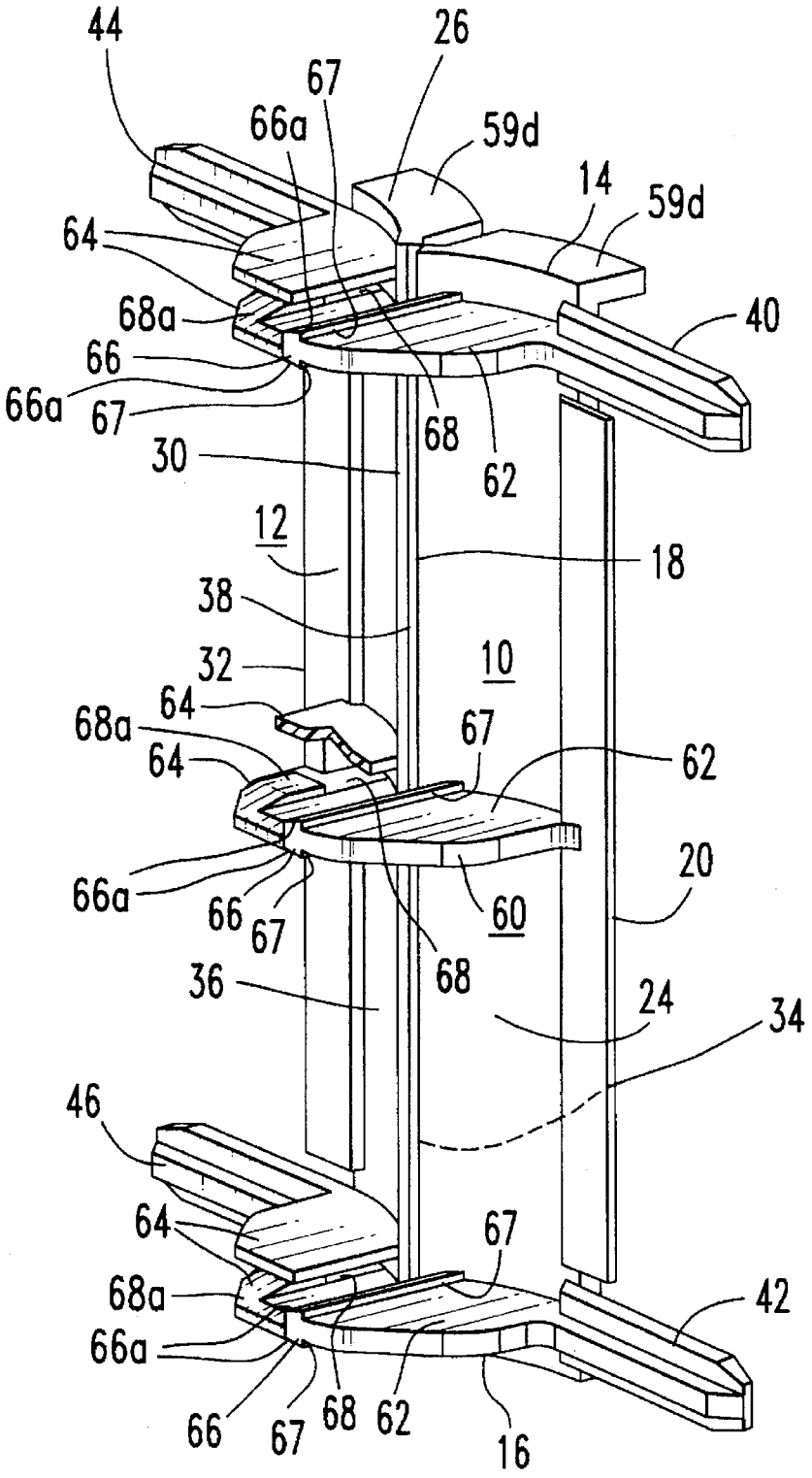
FIG. 1 is an orthogonal view of a valance connector with the detent in an unlocked position.

A presently preferred embodiment of the subject invention is first described in connection with FIGS. 1 and 2 wherein a valance connector includes a first panel 10 and a second panel 12. Preferably, first and second panels 10 and 12 are in the general shape of cylindrical sections. Panel 10 has oppositely disposed radial edges 14 and 16 and oppositely disposed longitudinal edges 18 and 20 that define an outer face 22 and an inner face 24. Similarly panel 12 has oppositely disposed radial edges 26 and 28 and oppositely disposed longitudinal edges 30 and 32 that define an outer face 34 and an inner face 36. The radial dimension of panel 10 is defined between outer face 22 and inner face 24. The radial dimension of panel 12 is defined between outer face 34 and inner face 36.

Panels 10 and 12 are pivotally connected along longitudinal edges 18 and 30 respectively by a hinge 38. Preferably, panels 10 and 12 are made of a thermosetting plastic and hinge 38 is formed of a ribbon of such plastic. Preferably the sides of hinge 38 are monolithically formed with panels 10 and 12 such that hinge 38 has boundaries 39*a* and 39*b* that are defined by sides 18 and 30 of panels 10 and 12 and hinge 38 is integrally connected to panels 10 and 12. Hinge 38 has a relatively small radial dimension in comparison to the radial thickness of panels 10 and 12. In this way, panels 10 and 12 and hinge 38 are of monolithic construction where hinge 38 is a relatively thin section that allows flexure of hinge 38 such that panel 10 pivots about hinge 38 with respect to panel 12.

Panel 10 further includes at least one projection such as fingers 40 and 42 that extend away from longitudinal edge 20. Similarly, panel 12 further includes at least one projection such as fingers 44 ad 46 that extend away from longitudinal edge 32. As more particularly shown in connection with FIGS. 2 and 3, fingers 40 and 42 are aligned so as to engage channels 48 and 50 of a valance return 52. Similarly, fingers 44 and 46 are aligned so as to engage channels 54 and 56 of a valance headrail 58.

Figure 2:
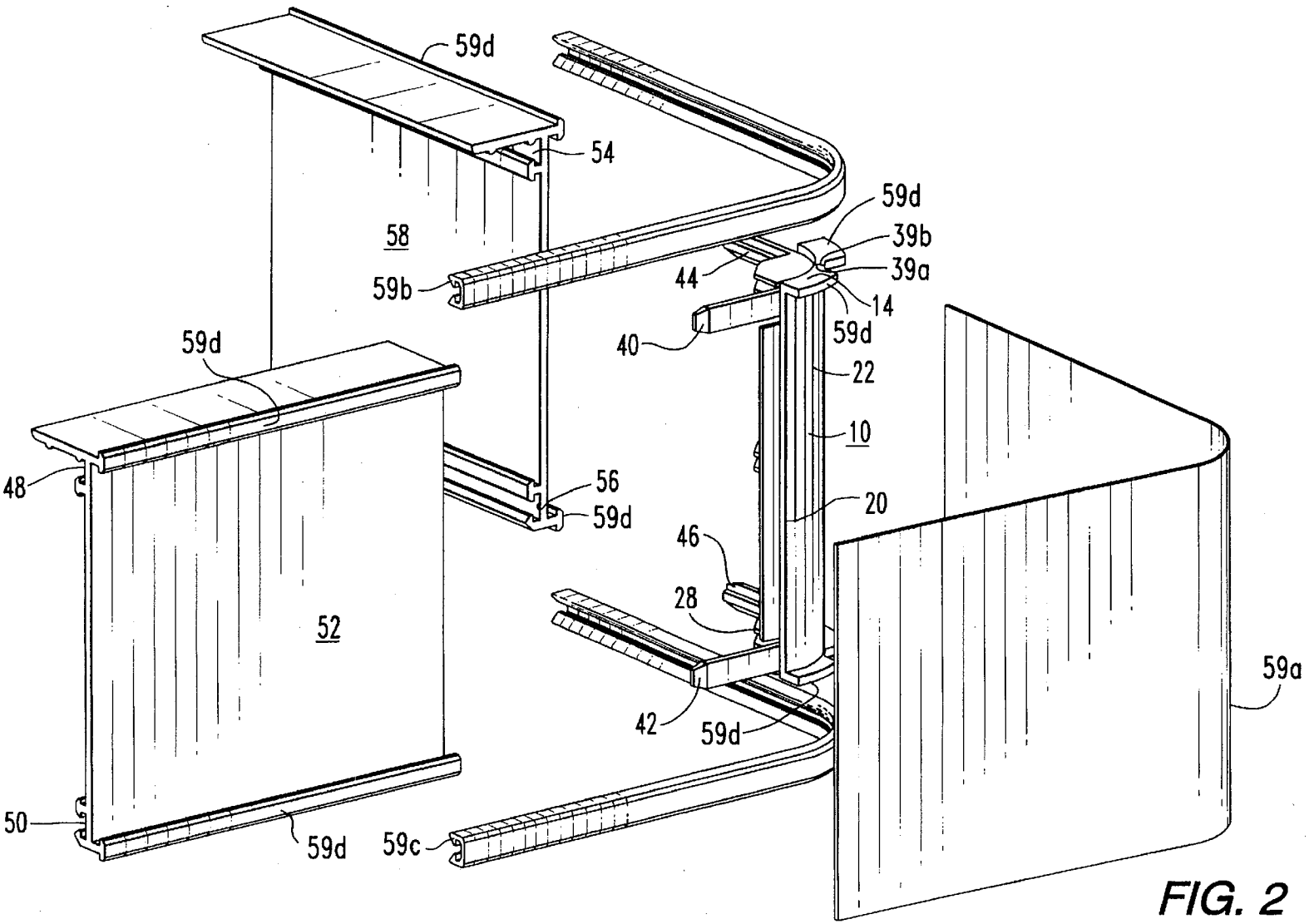
FIG. 2 is an exploded view of a valance connector in accordance with the subject invention together with other elements of the valance.
Figure 3:
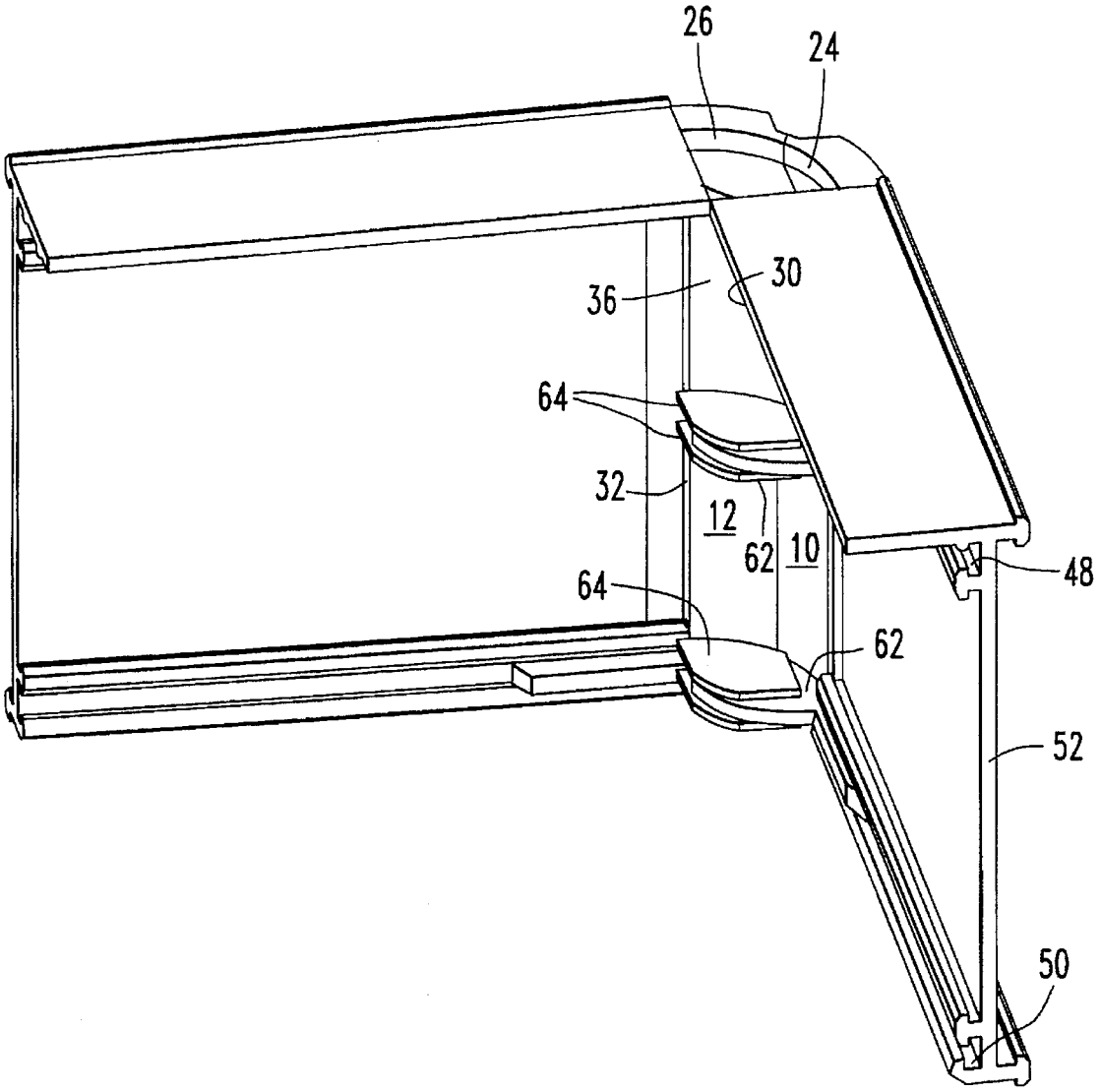
FIG. 3 shows a partial view of an assembled valance wherein the connector detent is in a locked position.

As also shown in FIG. 2, the valance assembly also includes an ornamental fabric 59*a* that is retained on panels 10 and 12, valance return 52 and valance headrail 58 by trim strips 59*b* and 59*c*. Strips 59*b* and 59*c* snap over trim rail guides 59*d* as is well known in the art.

To maintain the valance corner such that panel 10 is at a selected angular position with respect to panel 12, the panels 10 and 12 are provided with a latch means or detent 60. Detent 60 includes at least one extension member such as an array of plates 62 that are rigidly connected to inner face 24 of panel 10 and extend substantially normally from face 24. Detent 60 further includes a second extension member such as an array of planar members 64 that are rigidly connected to the inner face 36 of panel 12 and extend substantially normally from face 36. In the preferred embodiment, planar members 64 are arranged in pairs on panel 12 in correspondence with the location of plates 62 on panel 10 although other arrangements of members 64 could also be used within the scope of the present invention. In addition, members 64 are spaced apart by dimensions that allow each pair of planar members 64 to receive therebetween the corresponding plate 62 as panels 10 and 12 are pivoted together about hinge 38.

To maintain panels 10 and 12 at a selected angular position defined by the included angle between face 24 of panel 10 and face 36 of panel 12, each plate 62 is provided with a lateral protrusion such as a wedge-shaped edge 66 having an inclined surface 66*a* with an apex that forms a barb 67. The faces 68*a* of members 64 that oppose the inclined surface 66*a* of the corresponding plate 62 are provided with a recess such as groove 68 that receives the barb 67 of inclined surface 66*a*. Grooves 68 are located at a position on the opposing face of members 64 and barbs 67 are located at a position on plate 62 such that barbs 67 engage grooves 68 when panel 10 is at a selected angular position with respect to panel 12. The angular position at which the engagement of barb 67 and groove 68 occurs depend on the location of both barb 67 relative to face 24 and the location of groove 68 relative to face 36. Accordingly, the angular position for engagement of detent 60 is determined by the location of barb 67 on plate 62 and groove 68 on member 64. With barbs 67 engaged with grooves 68, detent 60 is engaged and plates 62 are maintained at fixed relationship to planar members 64 and panels 10 and 12 are maintained at the selected angular position.

In accordance with the subject invention, the valance connector is shipped in a flat or open position as shown in FIG. 1. When the valance connector is assembled with valance return 52 and headrail 58, it is maintained in an angular position by detent 60 which maintains panel 10 at a selected angular position with respect to panel 12. As particularly shown in FIGS. 2 and 3, detent 60 maintains panel 10 in an angular position with respect to panel 12 such that fingers 40 and 42 extend in a direction that is generally orthogonal with respect to fingers 44 and 46 and valance return 52 is generally orthogonal with respect to valance headrail 58.

Alternatively, barbs 67 can have other locations with respect to face 24 of panel 10 and recesses or grooves 68 can have other locations with respect to face 36 of panel 12. By selecting the location of barbs 67 and grooves 68, either separately or in combination, barbs 67 can be received in grooves 68 so that detent 60 engages when panels 10 and 12 are at various angular positions. Depending on the particular location of barb 67 and groove 68 in detent 60, when the detent is engaged the angle defined between panel 10 and panel 12 can be a right angle, an obtuse angle, or even an acute angle.

Figure 4:
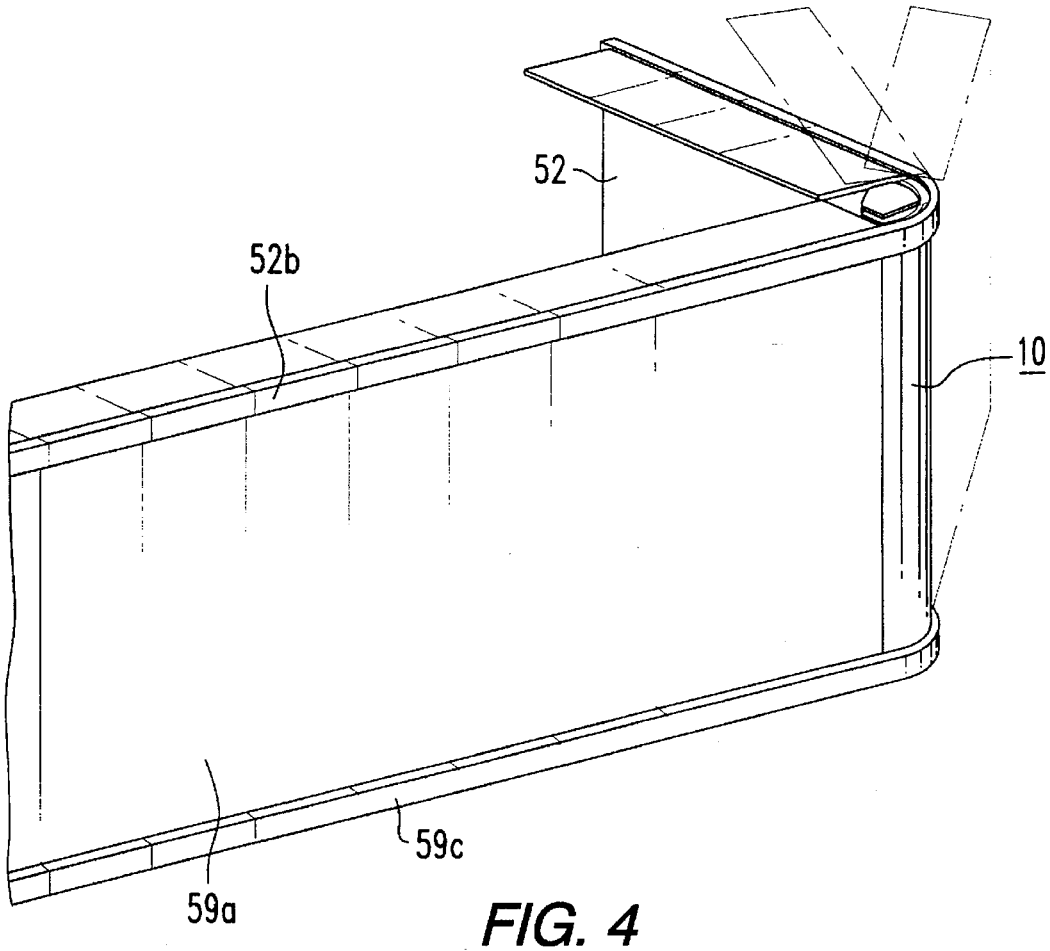
FIG. 4 shows a partial view of an assembled valance with dashed lines to indicate alternative angular positions at which the connector detent is locked.
Figure 5:
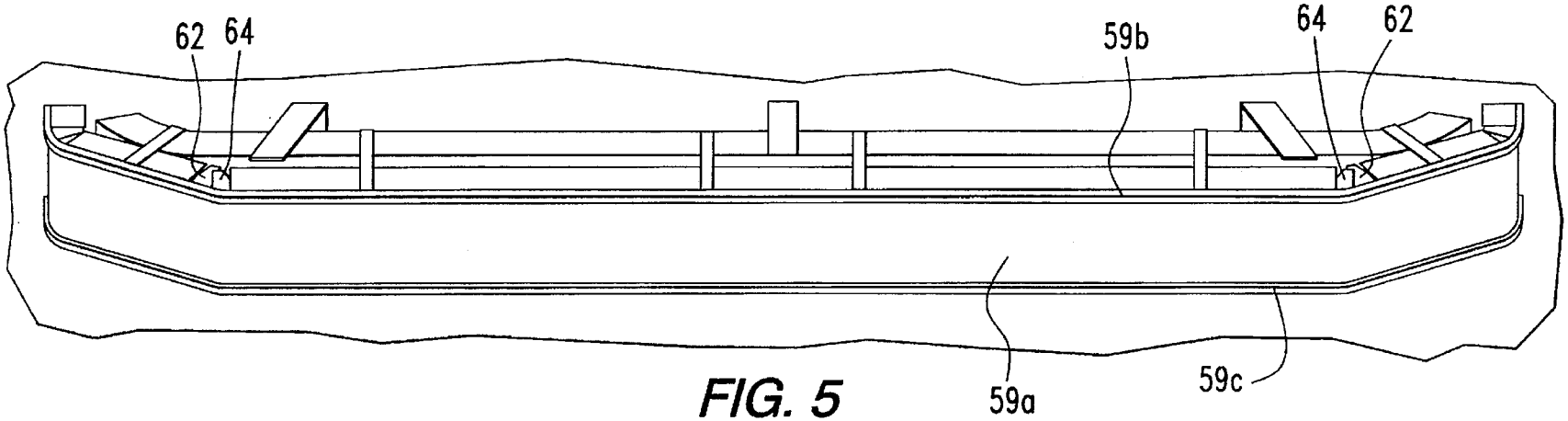
FIG. 5 is an orthogonal view of an assembled valance wherein four connectors each have respective panels that define obtuse angles to provide a beveled connection between the front panel and the return.
Figure 6:
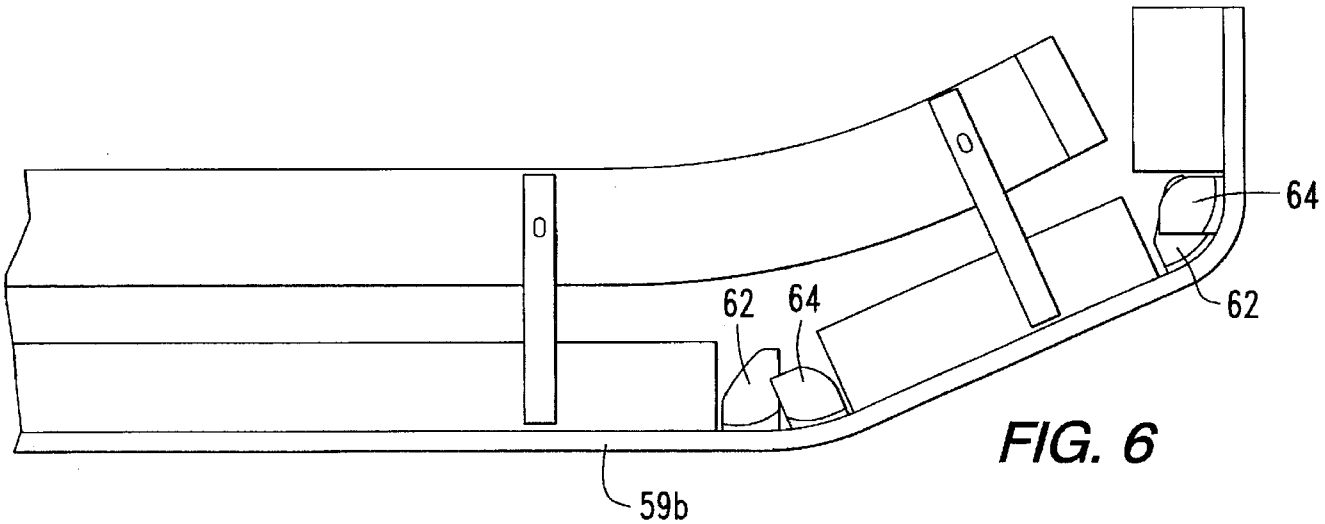
FIG. 6 is a top view of the beveled valance assembly shown in FIG. 5.
Figure 7:
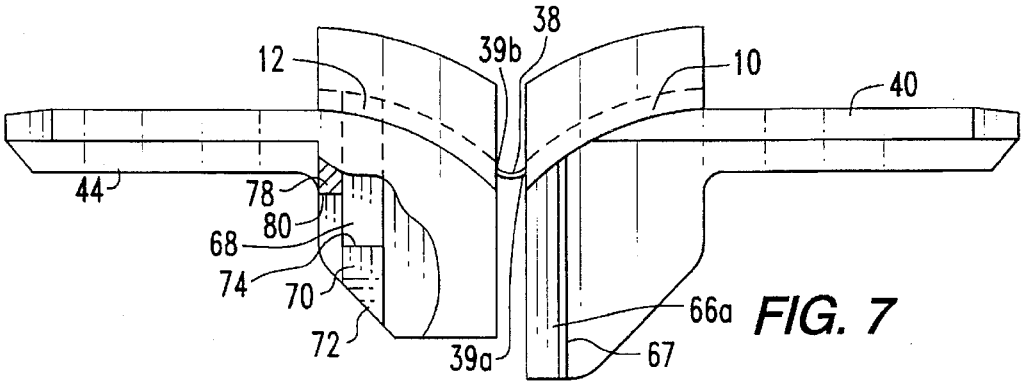
FIG. 7 is a top view of a valance connector with the detent in an unlocked position.
Figure 8:
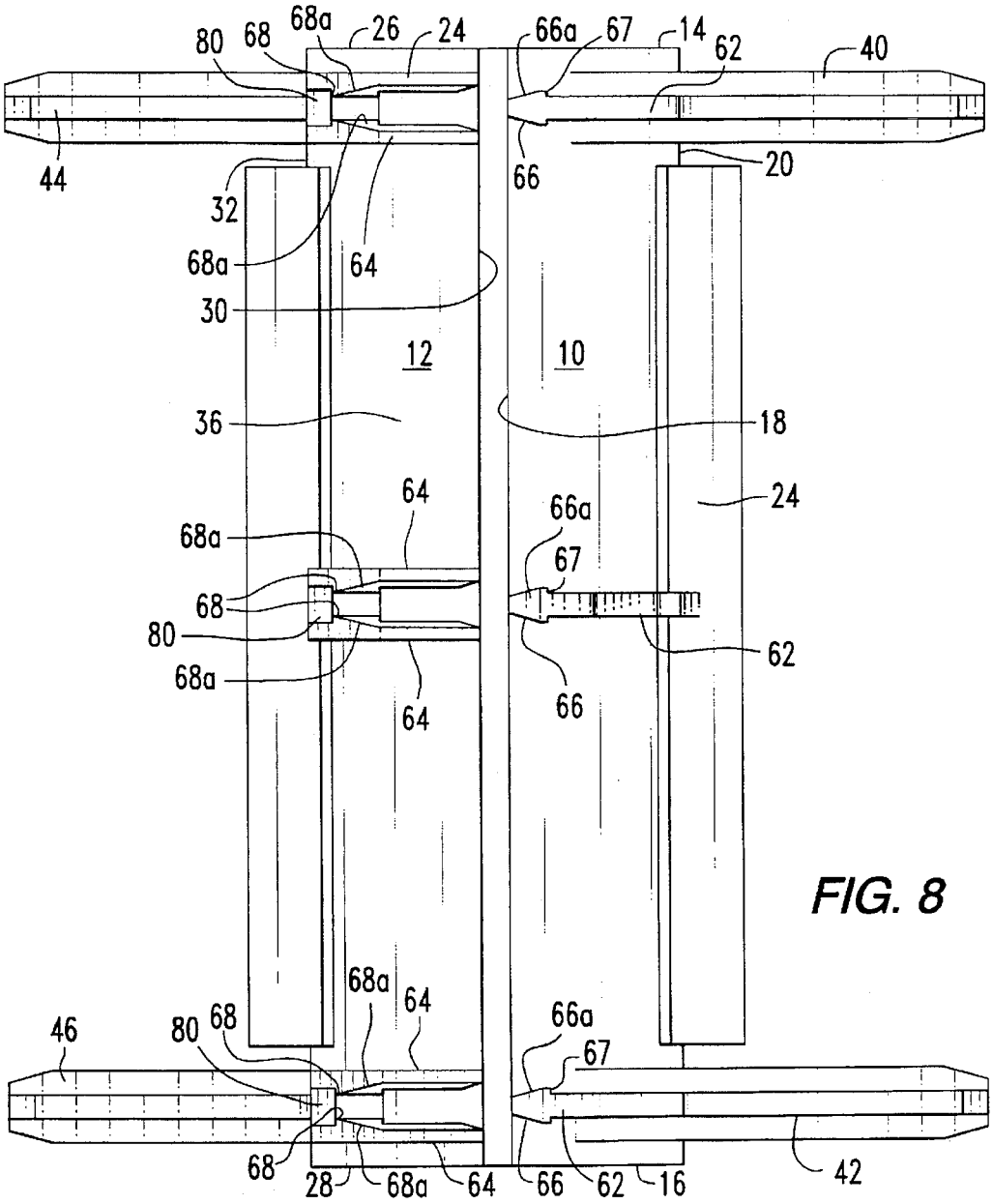
FIG. 8 is an elevation view of the valance connector shown in FIG. 7.
Figure 9:
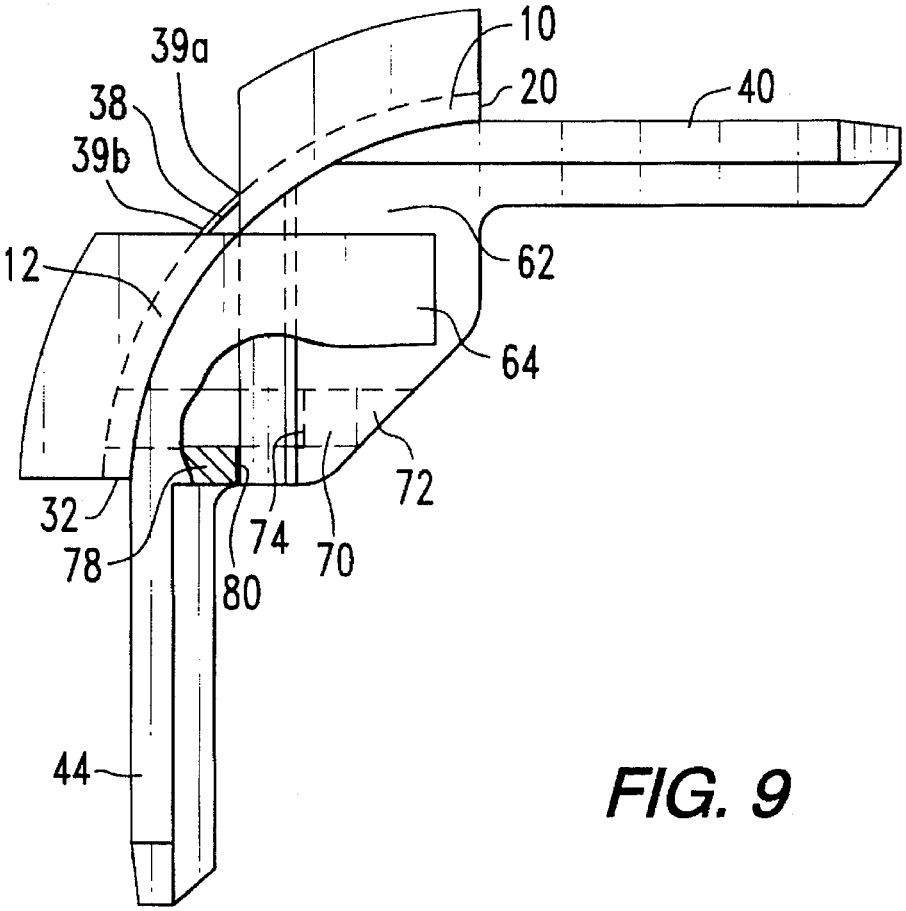
FIG. 9 is a top view of a valance connector with the detent in a locked position.
Figure 10:
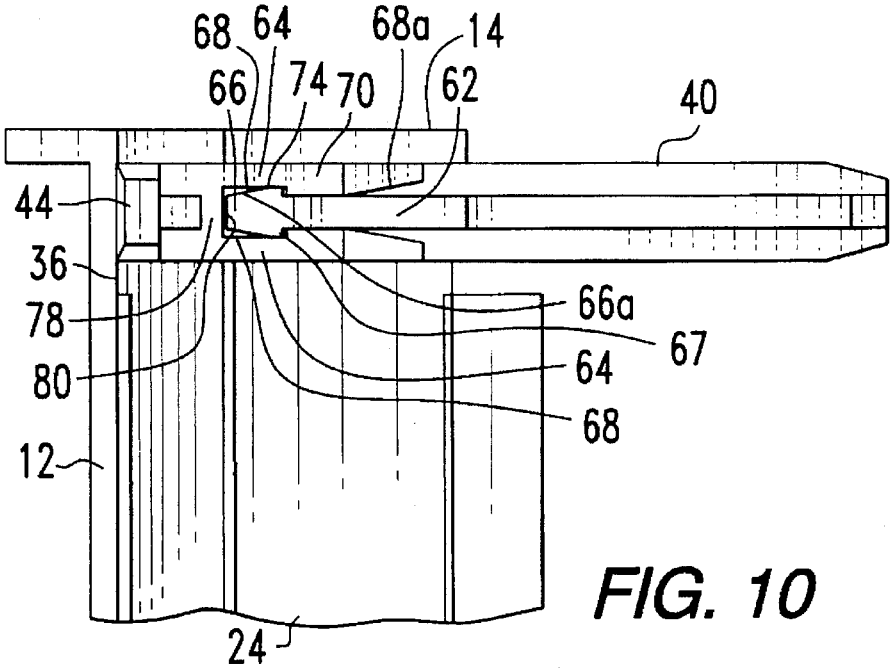
FIG. 10 is a partial elevation view of the valance connector shown in FIG. 9.

By including a plurality of recesses or grooves 68 in the same member 64, detent 60 can engage at a corresponding number of alternative angular positions of panels 10 and 12. In the embodiment of FIG. 4, the detent 60 engages in two additional angular positions where fingers 40 and 42 are in obtuse or non-orthogonal relationship with respect to fingers 44 and 46. This allows the valance return 52 to be oriented at an obtuse angle with respect to the headrail 58. As shown in FIGS. 5 and 6, additional connectors can be used in the valance assembly and the included angle between panels 10 and 12 made obtuse to give the valance assembly a beveled appearance. Alternatively, still more connectors could be used with the included angle between panels 10 and 12 of each connector being obtuse to give the valance assembly a polygonal or even rounded appearance.

Preferably, plates 62 and members 64 are made of plastic or other materials that have sufficient elasticity that plates 62 and wedge-shaped edges 66 will deflect corresponding members 64 while plates 62 and members 64 are moved together. The elasticity of members 64 also biases the member pairs toward their corresponding plates 62 so that when barbs 67 come into registry with grooves 68, the barbs 67 are urged into grooves 68. Overcoming detent 60 and changing the angular position of panels 10 and 12, requires overcoming the bias force and deflecting members 64 to move barbs 67 out of grooves 68.

As more particularly shown in FIGS. 7, 8, 9 and 10, member 64 and groove 68 can be embodied as a substantially planar member 64 that includes a raised portion or land 70. Land 70 is provided with a ramped side 72 and a normal side 74. Ramped side 72 is inclined with respect to the planar face of member 64 and is oriented on member 64 such that ramped side 72 engages inclined surface 66*a* as panel 10 is pivoted angularly toward panel 12. As panel 10 is pivoted angularly further toward panel 12, members 64 are deflected laterally away from the corresponding plate 62. When panel 10 and panel 12 are angularly rotated such that barb 67 of inclined surface 66*a* passes over normal side 74 of land 70, land 70 is no longer in contact with inclined surface 66*a* and member 64 returns to its unbiased lateral position. The lateral movement of member 64 causes normal side 74 of land 70 to move laterally toward plate 62 across the travel path of barb 67. Thus, normal side 74 of land 70 obstructs the movement of barb 67 in the return direction.

As shown in FIGS. 7, 8, 9 and 10, a stop 78 is bridged between the opposed pair of members 64. Stop 78 has a surface 80 that is spaced from normal side 74 of land 70 such that inclined surface 66*a* and barb 67 are received between stop surface 80 and normal side 74 when panels 10 and 12 are pivoted angularly together and barb 67 passes side 74. Thus, normal side 74 obstructs the movement of barb 67 in the return direction and stop 78 obstructs the movement of wedge-shaped edge 66 in the advancing direction. Accordingly, members 64 engage barb 67 and stop 78 engages wedge-shaped edge 66 so that detent 60 is in the locked or secured position.

While a presently preferred embodiment of the invention disclosed herein has been shown and described, the invention is not limited thereto, but may be otherwise embodied within the scope of the following claims.

I claim:

1. A valance wherein a connector joins a valance return to a valance headrail, said valance return and said valance headrail including trim rail guides and a fabric between said trim rail guides, said fabric being retained on said valance return and said valance headrail by first and second trim strips, said valance comprising:

a first cylindrical section having longitudinal edges that are oppositely disposed on said first cylindrical section;

a second cylindrical section having longitudinal edges that are oppositely disposed on said second cylindrical section;

first and second trim rail guides connected to said first cylindrical section, said trim rail guides cooperating with the trim strips to retain the fabric on said first cylindrical section;

first and second trim rail guides connected to said second cylindrical section, said trim rail guides cooperating with the trim strips to retain the fabric on said second cylindrical section;

a hinge that is connected to one longitudinal edge of said first section and that is also connected to one longitudinal edge of said second section such that said hinge connects the first and second sections together and such that the first section pivots on said hinge with respect to the second section;

at least one projection that extends from the longitudinal edge of said first section that is oppositely disposed from the one edge that is connected to said hinge, said projection being adapted for engagement with said valance return;

at least one projection that extends from the longitudinal edge of said second section that is oppositely disposed from the one edge that is connected to said hinge, said projection being adapted for engagement with said valance headrail; and a detent for maintaining said first section at a selected angular position with respect to said second section, said detent including at least one extension member that is secured to said first section and that includes a lateral protrusion that is secured to surface of said one extension member, said detent further including a second extension member that is secured to said second section, said second extension member having a recess that receives the lateral protrusion of said extension member when said first section is at a selected angular position with respect to said second section to maintain said one extension member in fixed relationship with said second extension member and to maintain said first section at a selected angular position with respect to said second section.

2. The connector of claim 1 wherein said lateral protrusion includes a surface that is inclined with respect to the surface of the extension member that it is secured to.

3. The connector of claim 2 wherein said inclined surface forms an apex that is in the shape of a barb.

4. The connector of claim 1 wherein said lateral protrusion is in the general shape of a wedge.

5. A valance wherein a connector joins a valance return to a valance headrail, said valance return and said valance headrail including trim rail guides and a fabric between said trim rail guides, said fabric being retained on said valance return and said valance headrail by first and second trim strips, said valance comprising:

a first cylindrical section having longitudinal edges that are oppositely disposed on said first cylindrical section;

a second cylindrical section having longitudinal edges that are oppositely disposed on said second cylindrical section;

a hinge that is connected to an edge of said first section and that is also connected to an edge of said second section such that the sections are connected together by said hinge and such that the sections pivot with respect to each other;

first and second trim rail guides connected to said first cylindrical section, said trim rail guides cooperating with the trim strips to retain the fabric on said first cylindrical section;

first and second trim rail guides connected to said second cylindrical section, said trim rail guides cooperating with the trim strips to retain the fabric on said second cylindrical section;

at least one projection that extends from an edge of said first section that is oppositely disposed from said hinge;

a second projection that mends from an edge of said second section that is oppositely disposed from said hinge; and a latch for maintaining said first and second sections at a fixed angular position about said hinge, said latch including at least one extension member that is secured to said first section and that includes a lateral protrusion located at the distal portion thereof, said latch further including a means for receiving said extension member, said receiving means being secured to said second section and having a recess that engages the lateral protrusion when said first section is at a selected angular position with respect to said second section such that when the lateral protrusion is engaged with the recess said extension member is secured in fixed relationship with said receiving means and said first section is secured at a selected angular position with respect to said second section.

6. A valance wherein a connector joins a valance return to a valance headrail, said valance return and said valance headrail including trim rail guides and a cover between said trim rail guides, said cover being retained on said valance return and said valance headrail by first and second trim strips, said valance comprising:

a first cylindrical section having longitudinal edges that are oppositely disposed on said first cylindrical section, said first cylindrical section also having radial edges that are oppositely disposed on said first cylindrical section;

a second cylindrical section having longitudinal edges that are oppositely disposed on said first cylindrical section, said second cylindrical section also having radial edges that are oppositely disposed on said second cylindrical section;

first and second trim rail guides that are connected to said first cylindrical section adjacent to respective radial edges of said first cylindrical section, said trim rail guides cooperating with the trim strips to retain the cover on said first cylindrical section;

first and second trim rail guides that are connected to said second cylindrical section adjacent to respective radial edges of said second cylindrical section, said trim rail guides cooperating with the trim strips to retain the cover on said second cylindrical section;

a hinge that is connected to one side of said first section and to a side of said second section that is arranged in opposing relationship to said first section such that said first and second sections can be pivoted with respect to each other about said hinge;

a first extension member that is secured to said first section, said first extension member being adapted for engagement with one segment of said valance;

a second extension member that is secured to said second section, said second extension member being adapted for engagement with another segment of said valance;

a first latch member that is secured to said first section; and a second latch member that is secured to said second section and that engages the first latch member when said first section is located at a predetermined angular position with respect to said second section, said second latch member cooperating with said first latch member to maintain said first and second sections at a given angular position about said hinge.

7. The valance of claim 6 wherein said first latch member comprises at least one plate member that includes a lateral extension, and wherein said second latch member comprises at least two planar members that are laterally spaced in a substantially parallel relationship such that said plate member is received therebetween as said first section is pivoted about said hinge.

8. The valance of claim 7 wherein the lateral extension of said plate member is received in a recess formed in at least one of said planar members, said recess being located on said planar member such that the lateral extension engages said recess when said first section is at a given angular position with respect to said second section.

9. The valance of claim 8 wherein the two planar members of said second latch member have respective face surfaces that are oriented in opposing relationship, and wherein said recess is formed in at least one of said face surfaces.

10. The valance of claim 7 further comprising a stop that Is located between the two laterally spaced planar members, said stop cooperating with said two planar members to define a recess for receiving the lateral extensions of said plate member when said first section is located at a predetermined angular position with respect to said second section.

11. The valance of claim 10 wherein said two planar members of said second latch member have respective lands that are located in opposing relationship, each of said lands having a respective side that is spaced apart from said stop to define a groove between said stop and the side of said lands, said groove receiving the lateral extension of said plate member when the angular position of said first and second sections is such that said lateral extension is in registry with said groove.

12. The valance of claim 11 wherein the lands of said two planar members include respective ramped surfaces that contact the lateral extension of said plate member as said first section is pivoted with respect to said second section such that said plate member urges said planar members laterally away from said plate member as said first section is pivoted in the direction of said predetermined angular position with respect to said second section.

13. The valance of claim 11 where the stop is spaced apart from a side of a land, said stop cooperating with said land to define a recess area for receiving the lateral extension of said plate member.

* * * * *